US005236385A

United States Patent [19]

May

[11] Patent Number: 5,236,385

[45] Date of Patent: Aug. 17, 1993

[54] MECHANICAL DOLL ASSEMBLY CAPABLE OF SIMULATING SLEEP

[75] Inventor: Richard L. May, Manhattan Beach, Calif.

[73] Assignee: California R&D Center, Inc., Westwood Village, Calif.

[21] Appl. No.: 832,234

[22] Filed: Feb. 7, 1992

[51] Int. Cl.[5] ..... A63H 3/28; A63H 3/20; A63H 3/36

[52] U.S. Cl. ..... 446/300; 446/330; 446/338

[58] Field of Search ..... 446/300, 298, 297, 317, 446/330, 351, 352, 353, 354, 376, 378, 379, 337, 338, 340

[56] References Cited

U.S. PATENT DOCUMENTS

| | | | |
|---|---|---|---|
| 898,813 | 9/1908 | Woolnough | 446/298 |
| 2,288,371 | 6/1942 | Rothschild | 446/354 |
| 2,565,603 | 8/1951 | Fraysur | 446/297 X |
| 2,596,491 | 5/1952 | Kinberg | 446/354 |
| 2,616,216 | 11/1952 | Fraysur | 446/300 X |
| 3,227,825 | 1/1966 | Pullen | 446/354 X |
| 3,419,994 | 1/1969 | Glass et al. | 446/300 |
| 3,465,474 | 9/1969 | Gardel et al. | 446/376 X |
| 3,922,813 | 12/1975 | Terzian et al. | 446/354 |
| 4,266,367 | 5/1981 | Kuna et al. | 446/354 X |
| 5,141,464 | 8/1992 | Stern et al. | 446/338 |

FOREIGN PATENT DOCUMENTS

| | | | |
|---|---|---|---|
| 92716 | 1/1922 | Switzerland | 446/354 |

*Primary Examiner*—Robert A. Hafer
*Assistant Examiner*—D. Neal Muir
*Attorney, Agent, or Firm*—Price, Gess & Ubell

[57] ABSTRACT

An animated toy doll which simulates a baby falling asleep is provided. Initially, the doll sits upright. A mechanical internal mechanism is provided for tilting or nodding the head forward, and then tilting the entire torso rearward to a final reclined sleeping position. The motions of the doll are triggered by squeezing one of the feet of the doll. Motion of the internal mechanism is dampened by a thick silicone gel to ensure slow and smooth movement of the mechanism to achieve a realistic, graceful animation of the doll. No electrical device or motor is required.

13 Claims, 3 Drawing Sheets

MECHANICAL DOLL ASSEMBLY CAPABLE OF SIMULATING SLEEP

BACKGROUND OF THE INVENTION

1. Field of the Invention

The present invention relates generally to dolls and, more particularly, to dolls provided with mechanical means for animated movement.

2. Description of Related Art

Numerous mechanisms have been devised to animate the head and limbs of dolls or mannequins to impart lifelike movement. Typically, an electric motor, wound spring, or other drive means is employed to rotate a series of gears, pulleys, cams, and cranks that actuate various followers, levers, rods, and arms to achieve desired movement. The utilization of complicated mechanical means within the doll, particularly when used in combination with an electric motor, often results in an undesirable amount of noise during the movement of the doll. A realistic emulation of lifelike movement is thwarted by the various electrical or mechanical sounds emanating from the doll. Furthermore, such complicated mechanical or electromechanical mechanisms are often expensive to manufacture and are insufficiently reliable.

One goal of doll animation is to achieve a lifelike simulation of sleep. Such is conventionally achieved by weighting the eyes of the doll to close when the doll is manually held in a reclined position.

SUMMARY OF THE INVENTION

It is an object of the invention to provide an animated doll whose animated movements are driven solely by a quiet mechanical means;

It is a further object of the invention to provide an animated doll whose mechanical movement is driven by a single mainspring;

It is a further object of the invention to provide an animated doll whose mechanical movement is dampened and slowed by friction fittings to achieve a quiet, lifelike movement; and It is a further object of the invention to provide an animated doll capable of providing a lifelike simulation of a baby or small child going to sleep.

These and other objects of the invention are achieved by a toy doll having mechanical means for smoothly repositioning the doll from a sitting position to a reclined position.

In accordance with a preferred embodiment of the invention, the toy doll includes a torso, a pair of legs pivotally mounted to a bottom portion of the torso, and means mounted within the torso for automatically pivoting the torso with respect to the legs. The legs and torso are pivotable between a sitting position wherein the legs extend forwardly from the torso for supporting the torso upright on a supporting surface, and a reclined position wherein the legs extend generally parallel with the torso for allowing the torso and legs to lie supine on the supporting surface. Means mounted within the torso automatically pivot the torso from the upright position to the reclined position.

Also preferably, the doll includes a head which is pivotally mounted on the torso for tilting or nodding forward before the torso is caused to pivot backwards to the reclined position. The head is pivotally mounted and weighted such that, once released by a first triggering mechanism, gravity causes the head to tilt forward until a chin of the head is proximate to a chest of the torso and the head reaches the forward position, a second triggering mechanism is activated to pivot the torso rearwardly to the reclined position. After the torso has been pivoted rearwardly, gravity again causes the head to pivot, this time causing the head to pivot rearwardly until the head lies on the surface parallel with the torso and legs. Pivoting of the torso with respect to the legs is preferably accomplished solely by a single quiet mechanical spring.

When activated, the head of the doll smoothly and quietly nods forward to provide the appearance that the doll is starting to fall asleep. Then, the torso of the doll automatically pivots rearwardly until reaching a supine position to provide the appearance that the doll is falling more fully asleep. Finally, the head pivots rearwardly until it also lies on the supporting surface to complete a simulation of a baby or small child falling asleep.

The various movements are achieved solely by mechanical means using a single main spring and further exploiting simple gravity. To achieve a realistic slow and quiet movement of the head, legs, and torso, various internal mechanical components are dampened by friction producing means using heavy silicone grease. Various compression springs are provided to press the mechanical components against the heavy silicone grease to ensure slow, smooth, and quiet mechanical movement.

The feet of the doll are preferably weighted by a sufficient amount to prevent the doll from abruptly tipping over while the torso is pivoted rearwardly to the supine position. The weighted feet help to further ensure that the doll remains securely in the sitting position prior to activation of the animation mechanisms.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

Figure 1A:
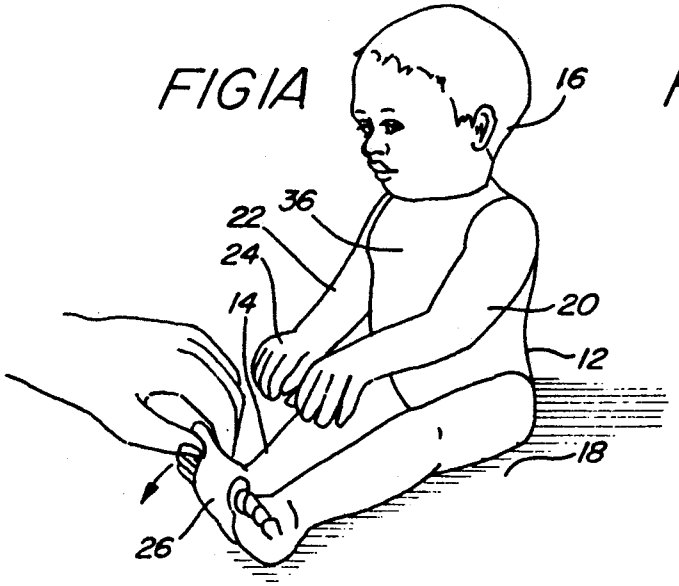
FIGS. 1(*a*)–1(*d*) show a sequential perspective view of a doll constructed in accordance with the preferred embodiment of the invention, showing the doll automatically moving from a fully awake position to a fully asleep position.
Figure 1B:
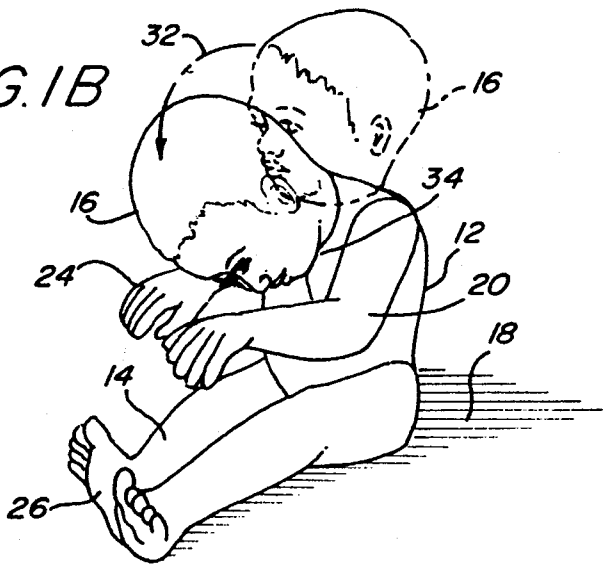
Figure 1C:
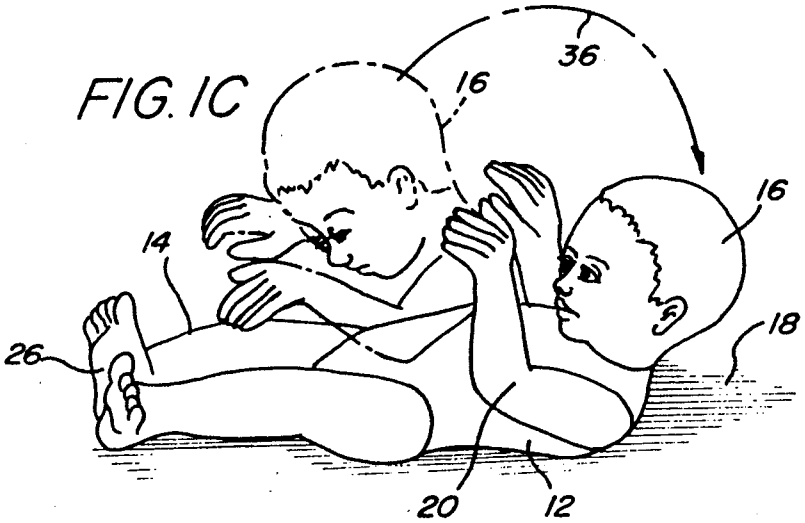
Figure 1D:
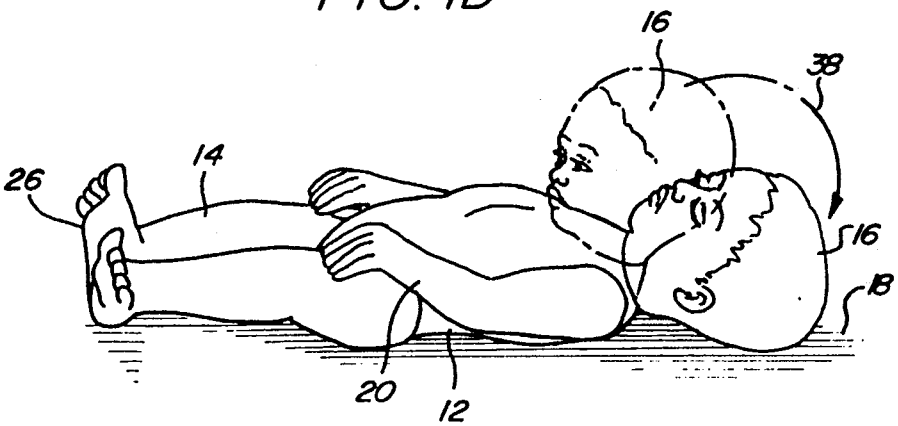

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a toy doll capable of automatically moving from a sitting awake position to a reclined sleeping position. The movement is achieved solely by mechanical means.

Referring to the figures, a preferred embodiment of the invention will now be described.

In FIG. 1, a toy doll 10 is shown automatically moving from a fully awake position to a fully asleep position. Doll 10 includes a torso 12, a pair of legs 14, and a head 16. In FIG. 1(*a*) toy doll 10 is shown in a fully awake position wherein legs 14 extend perpendicularly outward from torso 12 for supporting torso 12 in an upright sitting position on a supporting surface 18. In the fully awake position of FIG. 1(*a*), head 16 extends upright from torso 12, generally parallel with torso 12. A pair of arms 20 and 22, including hands 24, are also included. Arms 20 and 22 may be pivotally mounted to torso 12 for manual repositioning.

A triggering mechanism 28 is mounted within a foot 26. Trigger 28 is preferably located in the vicinity of the toes of foot 26 and is activated by manually squeezing the toe portion of foot 26. In FIG. 1(*a*) a hand 30 is shown preparing to squeeze the foot to activate trigger mechanism 28. The internal configuration of trigger mechanism 28, and the means by which it activates movement of toy doll 10, are described in greater detail below with reference to FIGS. 2 and 3.

Upon activation of doll 10, head 16 slowly and smoothly tilts or nods forward along the direction of arrow 32 of FIG. 1(*b*) to a first intermediate position shown in FIG. 1(*b*). In the intermediate position of FIG. 1(*b*), head 16 is tilted forward at an approximately 90-degree angle such that a chin 34 of head 16 is located proximate to a chest portion 36 of torso 12. FIG. 1(*b*) represents a configuration wherein the doll appears to be partially asleep. The slow, smooth movement of head 16 forward provides a realistic simulation of a baby initially beginning to fall asleep. As will be described more fully below, head 16 is pivotally mounted and weighted in a manner such that no mechanical or electrical motor is required to pivot the head forward. Rather, once released by trigger mechanism 28, gravity alone causes head 16 to pivot forward. Alternatively, a spring or other mechanism could be provided to urge the head forward.

Figure 2:
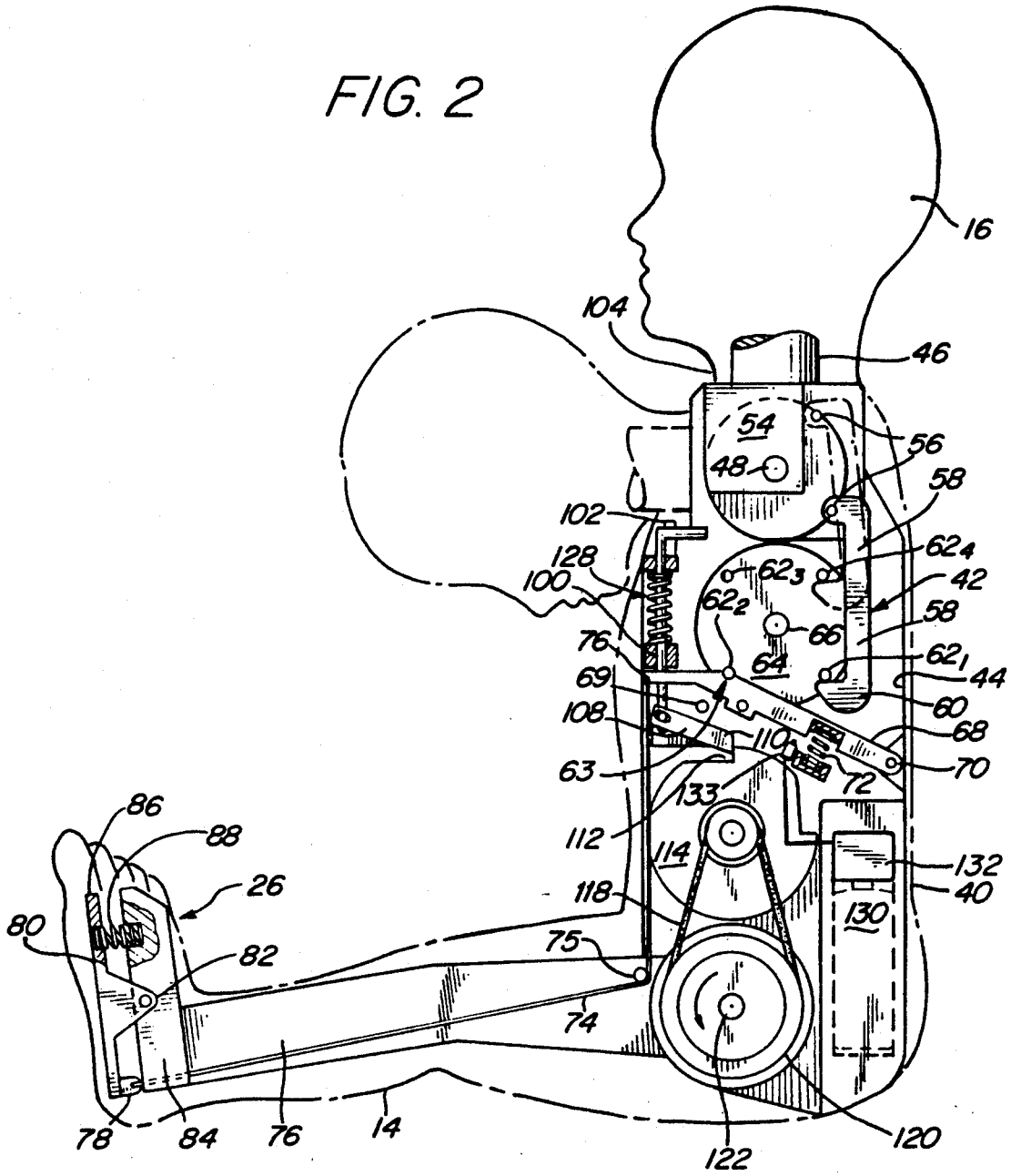
FIG. 2 is a side view, partially in cutaway, of the toy doll of FIG. 1, showing internal mechanisms of the doll.
Figure 3:
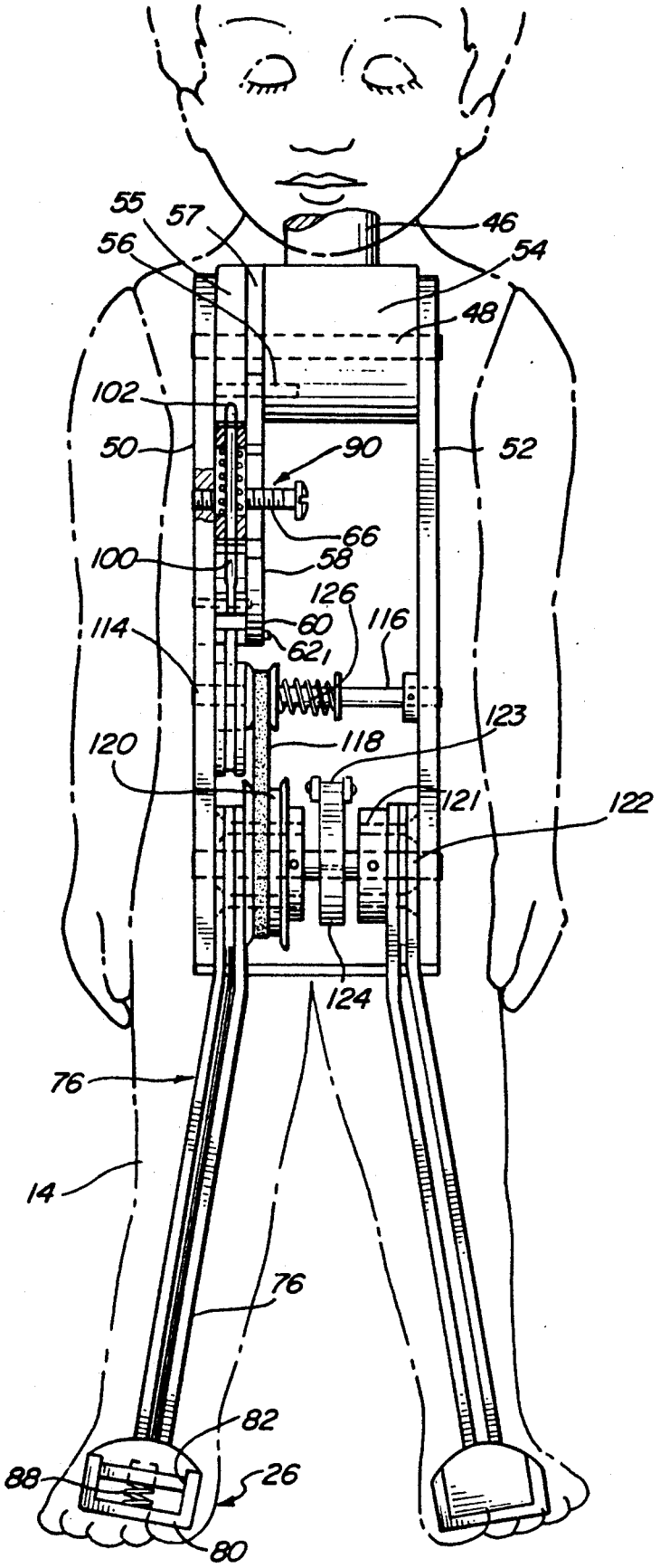
FIG. 3 is a front view, partially in cutaway, of the toy doll of FIG. 1, showing internal mechanisms of the doll.

Once head 16 reaches the position of FIG. 1(*b*), an internal secondary triggering mechanism, described in detail with reference to FIGS. 2 and 3, is activated. The secondary triggering mechanism activates an internally mounted pivot mechanism which causes torso 12 to pivot rearwardly, as indicated by the direction of arrow 36, until the torso lies supine on supporting surface 18 parallel with legs 14. This second intermediate position is shown in FIG. 1(*c*). As will be described below, feet 26 include sufficient weight to ensure that the legs remain on supporting surface 18 while the torso pivots rearwardly. Thus, the toy doll is prevented from tipping over abruptly.

Once toy doll 10 reaches the intermediate position of FIG. 1(*c*), gravity again causes head 16 to pivot, this time in a rearward direction, as shown by arrow 38. Head 16 pivots backwards until it rests against supporting surface 18 parallel with the legs and torso of the doll. The reclined or supine position of FIG. 1(*d*) represents a fully asleep configuration of the doll, simulating a final sleeping position of a baby or small child.

As will be described below, the internal mechanisms for pivoting the torso rearwardly is frictionally damped in such a manner that the torso moves slowly and quietly to provide a realistic impression of the doll falling asleep.

Once head 16 reaches the configuration of FIG. 1(*d*) wherein the head extends parallel with the torso, a stop and locking mechanism is engaged which stops further motion of the head and locks the head relative to the torso to prevent further pivoting of the head.

To return the doll to the fully awake position of FIG. 1(*a*), one merely manually grasps torso 12 and pivots the torso upwardly while keeping the legs positioned against supporting surface 18. Torso 12 is pivoted forwardly until it is substantially perpendicular to legs 14, as shown in FIG. 1(*a*), where a locking mechanism engages to lock the torso in the upright position. Once returned to the fully awake configuration of FIG. 1(*a*), the automatic mechanism may be reactivated to again cause the doll to automatically reposition itself to the fully asleep configuration of FIG. 1(*d*).

With reference to FIGS. 2 and 3, the internal mechanisms for moving the head, legs, and torso of doll 10 will now be described in detail. Hereinafter, the configuration shown in FIG. 1(*a*) is referred to as the fully awake configuration. The configuration of FIG. 1(*b*) is referred to as the partially awake configuration. The configuration of FIG. 1(*c*) is referred to as the partially reclined configuration. Finally, the configuration of FIG. 1(*d*) is referred to as the fully asleep or fully reclined or supine configuration.

Referring to FIG. 2, a side view of doll 10 is provided showing the doll in the fully awake configuration. In phantom lines, head 16 is shown pivoted forward to the partially awake configuration. In FIG. 3, the doll is shown, in top view, in the fully asleep configuration.

Referring initially to FIG. 2, torso 12 includes an outer shell 40, preferably constructed of a durable but lightweight plastic, and configured to represent the torso of a human baby or a small child. A cavity 42 is formed within shell 40 for containing various mechanical components necessary to animate the doll. Cavity 42 is preferably formed with flat internal side surfaces, including a new side surface 44.

Head 16 is pivotally mounted into chamber 42 by means of a shaft 46. Head 16 is preferably constructed of a durable but lightweight plastic molded in the shape of the head of a baby or small child. Head 16 includes a facial portion which may be molded to simulate any of a variety of human faces having any of a variety of expressions. Although not shown, mechanisms may be mounted within head 16 to animate movement of eyes, mouth, and chin of the face of the doll to provide further simulation of the doll falling asleep. In particular, the eyes can be pivotally mounted and weighted to close as the head tilts forward. Preferably, the eyes are mounted in such manner to remain closed until the doll is manually repositioned to the fully awake configuration of FIG. 1(*a*).

Neck shaft 46 is securely affixed to a neck axle 48, which extends horizontally across chamber 42, connecting a pair of opposing interior side walls 50 and 52. Axle 48 is pivotally mounted to side walls 50 and 52 for rotational movement along an axis extending longitudinally through the axle.

Head 10 is formed such that the center of gravity of the head is positioned forward of axle 48, thus biasing the head to pivot forward. Thus, were it not for a retaining mechanism, head 16 would automatically tilt forward while the torso is positioned upright.

To ensure that the center of gravity of the head is sufficiently forward to allow the head to tilt forward under the influence of gravity, weights can be included within the head in the vicinity of the face of the head. If the head is constructed of hollow plastic, the head can be simply molded or shaped in a manner to ensure a thick portion of plastic along the forward face. In an alternative embodiment, a spring or other biasing mechanism can be attached to head 16 to urge it forward, regardless of the location of the center of gravity within the head. Preferably, a second biasing mechanism would be provided to pivot the head rearwardly to achieve the final configuration of FIG. 1(*d*).

A main head pivot block 54, is affixed to one end of axle 48. A second head pivot block 55 is mounted to another end of axle 48. A slot 57 remains between the two pivot blocks. A dowel pin 56 extends between the two pivot blocks, as shown most clearly in FIG. 3. Alternatively, a single neck block may be provided with a slot formed partially through the single block.

A connecting pawl 58 mounts to dowel 56 and extends generally inwardly within chamber 42. A bottom end of pawl 58 includes a hook member 60 for engaging with a dowel pin 62 extending perpendicularly from a friction disk 64.

Friction disk 64 is mounted vertically within cavity 42 along an axle 66 which extends perpendicularly outward from interior side wall 50. Friction disk 64 is free to pivot about axle 66. However, axle 66 includes a compression spring, to be described below, provided to increase frictional resistance to rotational movement of disk 64 to ensure slow, smooth movement of the disk.

Disk 64 includes four dowels, generally denoted 62, each positioned 90 degrees apart around the perimeter of the disk. Hook 60 is initially engaged with a lower dowel $62_1$. Adjacent lower dowel $62_2$ is securely mounted within a detent 63 formed within a top edge of a release lever arm 68. Release lever 68 is pivotally mounted at a pivot point 7 to an interior rear wall 44 of cavity 42. A spring 72 pushes upwardly on a middle portion of lever arm 68 to ensure that detent 63 remains securely engaged with dowel $62_2$. This engagement prevents friction disk 64 from rotating about its axis and, since neck block 54 is connected to the friction disk by pawl 58, it too is prevented from rotating. Accordingly, head 16 remains fixed in the erect position shown in solid lines in FIG. 2. However, as noted above, head 16 is balanced such that a center of gravity of the head lies forward of axle 48. Therefore, were it not for the retaining means by which friction disk 64 is held in place, head 16 would naturally pivot forward to the forward position shown in phantom lines in FIG. 2. Although disk member 64 is shown as having four dowels, a greater number of dowels can be provided.

A cord 74 is affixed to a forward end of release lever 68. Cord 74 extends along internal cavity 42 and passes around a dowel pin 75 to extend forwardly through one of legs 14 within an internal narrow chamber 76 formed along the length of leg 14. A front end of cord 74 is securely affixed to a lower heel end 78 of a trigger arm 80. Cord 74 may be replaced by a monofilament or other linkage means.

Trigger arm 80 is mounted internally within foot 26 of leg 14. Trigger arm 80 is pivotally mounted at a pair of pivot points 82 to a foot weight 84, which is securely affixed within foot 26. An upper end 86 of trigger arm 80 is free to pivot inwardly, i.e., toward the torso of the doll. However, movement of lever arm 80 is biased in the opposite direction by a biasing spring 88 positioned between a top end of weight 84 and an inner edge of pivot arm 80. Foot 26 is sufficiently resilient to allow it to be squeezed inwardly to pivot arm 80.

Lever arm 80, biasing spring 88, cord 74, and lever arm 68 together comprise triggering mechanism 28 provided for releasing head 16 to allow the head to pivot forward. In use, upper end 86 of pivot arm 80 is pressed inwardly against weight 84 by squeezing foot 26, to thereby cause lower end 78 to pivot outwardly, thus drawing cord 74 outwardly. As cord 74 is pulled outwardly within leg 14 and, therefore, downwardly within cavity 42, forward end 76 of retaining lever 68 is pulled downwardly until dowel $62_2$ disengages from detent 63. Once disengaged, the forward bias of the head acts through pawl 72 to cause friction disk 64 to rotate in a counterclockwise direction, thus allowing neck pivot blocks 54 and 55 to likewise rotate in a counterclockwise direction to allow head 16 to pivot forwardly to the position shown in phantom lines in FIG. 2. Herein, "clockwise" and "counterclockwise" are defined with reference to the orientation of FIG. 2. During this movement, upper end 56 of pawl 58 is drawn upwardly within slot 57 to a position shown in phantom lines in FIG. 2. Since end 60 of pawl 58 remains hooked over dowel $62_1$, friction disk 64 also rotates.

Rotation of these components continues until head 16 pivots forward through an angle of 90 degrees. Dowel $62_2$ is thereby moved counterclockwise to the previous location of dowel $62_1$. Likewise, dowel $62_1$ is thereby moved counterclockwise to the previous location of dowel $62_4$. Dowel $62_3$ moves downwardly to engage with detent 63 in retaining lever 68.

Thus, by depressing lever arm 80, friction disk 64 is disengaged from retaining lever 68 and becomes free to rotate in the counterclockwise direction. The forward-located center of gravity of head 16 biases neck blocks 54 and 55 to rotate in the counterclockwise direction, to thereby exert an upward force on a rear dowel of friction disk 64 via pawl 58. Thus, once friction disk 64 becomes free to rotate, neck blocks 54 and 55 likewise become free to rotate, and gravity causes head 16 to pivot forward to the position shown in phantom lines in FIG. 2. No electrical mechanism is required to effect the movement of the head. Likewise, no mechanical device such as a spring is required. Rather, gravitational force acting on head 16 causes the head to pivot forward. However, a spring mechanism can alternatively be employed.

A compression spring 90, shown more clearly in FIG. 3, is mounted along axle 66 for pressing friction disk 64 against interior side wall 50. A heavy silicone gel is deposited between side wall 50 and friction disk 64 to increase friction between these two components. Compression spring 90 ensures that friction disk 64 remains firmly pressed against side wall 50 to maximize the friction generated by the heavy silicone gel. Because of the gel, friction disk 64 is prevented from spinning quickly about its axis. Rather, friction disk 64, once released from retaining lever 68, rotates slowly and smoothly. Accordingly, head 16 likewise moves slowly and smoothly. In this manner, the head is prevented from abruptly falling forward. Rather, a smooth, slow, graceful motion is achieved. The heavy silicon gel further serves to limit sounds from emanating from within cavity 42. Thus, forward movement of the head is achieved substantially without any noise. Alternatively, a flywheel governor may be used to slow the rotation of disk 64.

The means by which torso 12 is pivoted rearwardly to the partially reclined configuration of FIG. 1(*c*) will now be described, with continued reference to FIGS. 2 and 3. A torso release bar 100 is mounted vertically within chamber 42. An upper end 102 of the release bar is positioned within an open cavity along chest 36 of torso 12 in front of secondary neck pivot block 55. Upper end 102 is positioned such that, as head 16 pivots forwardly, a front surface of neck block 55 presses against upper end 102. Release bar 100 is slidably mounted such that neck block 55 depresses release bar 100 when the head reaches the forward position shown in phantom lines in FIG. 2. A bottom end of release bar 100 is affixed to a release pawl 108, which is horizontally mounted within cavity 42. Release pawl 108 is pivotally mounted at its center to interior side wall 50 of cavity 42. As release bar 100 is pushed downwardly, an interior end 110 of pawl 108 is pivoted upwardly.

Prior to displacement, inner end 110 of the release pawl engages with a detent 112 formed within a leg friction disk 114. Friction disk 114 is mounted on an axle 116 extending between interior side walls 50 and 52 of cavity 42. Leg friction disk 114 is mounted by a belt 118 to a leg pivot disk 120, which is mounted to an axle 122, also connecting interior side walls of the cavity. One of legs 14 is rigidly mounted to pivot disk member 120 for pivoting therewith. The other leg is mounted to a second pivot disk member 121 positioned on an opposite end of axle 122. A main spring 124 is mounted to axle 122 to strongly bias axle 122 in a counterclockwise direction. Main spring 124 may be a sturdy spiral spring having one end mounted to rear interior side wall 44 at point 123 and a second end mounted to axle 122.

Once the forward motion of head 16 depresses release bar 100, to thereby detach release pawl 108 from friction member 114, tension within main spring 124 is released, causing disk pivot members 120 and 121 to pivot about axis 122. This release of tension causes the legs and torso to pivot with respect to each other from the configuration of FIG. 1(*b*) to the configuration of FIG. 1(*c*). However, since legs 14 are positioned on supporting surface 18 and cannot move downwardly, torso 12 therefore pivots rearwardly. Through belt 118, friction disk 114 is likewise caused to pivot about its axis. Main spring 124 continues to recoil until torso 12 lies parallel with legs 14 in the configuration shown in FIG. 1(*c*). Preferably, the pulley ratio of pulley 118 is chosen such that friction disk 114 rotates once through approximately 360 degrees, while torso 12 rotates through an angle of approximately 90 degrees with respect to legs 14. In this manner, detent 112 formed within leg friction disk 114 rotates through a full arc to return to its initial position where it again is engaged by release pawl 108. Belt 118 may be replaced with a gear mechanism.

Axle 116 of friction disk 114 includes a compression spring 126, shown in FIG. 3, which presses friction disk 114 against interior side wall 50. A heavy silicone gel is disposed between the side wall and the friction disk to slow the speed of movement. Compression spring 126 ensures that friction disk 114 is pressed firmly against the heavy silicon gel to maximize friction. In this manner, rotational movement of friction disk 114 is slowed, i.e., friction disk 114 cannot quickly spin about its axis. Since disk pivot members 120 and 121 and main spring 124 are connected through belt 118 to the friction disk, these members likewise cannot spin quickly. Thus, abrupt movement of torso 12 is avoided. Rather, torso 12 slowly, smoothly, and quietly pivots rearwardly from the upright position of FIG. 1(*b*) to the reclined position of FIG. 1(*c*). Alternatively, a flywheel governor may be used, rather than silicone gel, to slow the rotation of disk 114.

Leg weights 84 are of sufficient weight to ensure that legs 14 remain against supporting surface 18 during movement of the torso. Without sufficient weight, the toy doll would abruptly tip over backwards during movement of the torso. Although shown mounted within the feet, the weight could alternatively be distributed along legs 14.

As torso 12 is pivoted rearwardly, head 16 is carried along with the torso. Although head 16 extends forward substantially parallel to support surface 18 in FIG. 1(*b*), by the time the doll reaches the configuration of FIG. 1(*c*), head 16 extends upwardly from supporting surface 18. The head is not locked in this configuration. Therefore, gravitational force causes the head to pivot backward along the direction of arrow 38 of FIG. 1(*d*).

Once the head starts to pivot, neck block 55 moves away from upper end 102 of release bar 100. A biasing spring 128, mounted along bar 100, urges bar 100 upward. In turn, interior end 110 of pawl 108 is urged downward to again engage with the detent formed within friction disk 114.

As head 16 continues to pivot rearwardly, pawl 58 is carried inwardly, i.e., toward the base of the torso, until lower end 60 hooks over dowel $62_2$ of upper friction disk 64. As discussed above, the forward movement of the head initially causes the dowels of friction disk 64 to each rotate by an approximately 90-degree angle. Therefore, the bottom left dowel $62_2$, shown in FIG. 2, is rearwardly moved to the position of dowel $62_1$ before pawl 58 returns to its locking position. Alternatively, pawl 58 can be affixed to dowel 62, to cause friction disk 64 to rotate clockwise by approximately 90 degrees to its original configuration.

In this manner, head 16 pivots rearwardly to reach the final fully asleep configuration shown in FIG. 1(*d*). Within this position, head 16 is again locked parallel with torso 12 by pawl 58.

To return doll 10 to the fully awake configuration of FIG. 1(*a*), torso 12 is manually held and pivoted upwardly. The forced pivot movement of torso 12 causes leg friction disk 114 to rotate in a counterclockwise direction until release pawl 108 again engages with detents formed within friction disk 114. Once reengaged, torso 12 is locked into the sitting position perpendicular to legs 14. Head 16 remains retained within the extended position of FIG. 1(*a*).

Thus, doll 10 may be automatically repositioned from the fully awake position of FIG. 1(*a*) to the fully asleep position of FIG. 1(*d*) solely by squeezing leg 26 to activate trigger mechanism 28. Movement of the head and torso is accomplished without any electrical mechanism. Rather, gravitational forces acting upon the head cause the head to pivot, first forwardly to the position of FIG. 1(*b*), then rearwardly to the position of FIG. 1(*d*). A single mainspring 124 is provided for pivoting the torso rearwardly. Heavy silicone gels are provided in combination with friction disks to ensure smooth, slow, quiet movement of the components with respect to each other. Thus, no abrupt movements occur. Rather, the doll slowly and gracefully first nods its head forward, then slowly reclines rearwardly to a fully asleep position.

If desired, a speaker may be provided within the doll for generating various sounds such as sounds representative of a baby falling asleep or reawakening. To this end, a battery 130 (FIG. 2) is shown mounted within cavity 42. Battery 130 is electrically connected to a sound generator 132, which provides the representative sounds. Any of a wide variety of conventional voice or sound synthesis devices can be included within sound generator 132 for generating a variety of appropriate sounds. Alternatively, prerecorded music such as, for example, Brahms' Lullaby, can be automatically played. The sound generator includes a switch 133 activated by movement of release bar 68. Thus, downward movement of release bar 68 simultaneously releases head 16 for forward pivoting and activates the sound generator. Switch 133 can be connected to other components, or an activation switch may be provided for manually activating the sound generator.

Doll 10 may include a garment in the form of pajamas or the like covering all portions of the outer surface of the doll other than hands 24 and head 16. Thus, feet 26 would be enclosed within garment 22.

By enclosing most of the doll in a garment, manufacturing costs may be reduced. Costs are minimized by covering the doll in a garment because the exterior of the doll, other than the head, need not be realistically rendered. For example, the feet need not be formed from a plastic sufficiently resilient to allow the foot to be squeezed to depress pivot member 86. Rather, the trigger mechanism components shown mounted inside the foot (FIG. 2) need only be covered by a cushioned portion of the garment. A realistic foot having toes need not be provided at all.

Furthermore, by providing an external garment, the arms need not be formed from plastic. Rather, a stuffed rag doll-type arm can be sewed onto the torso. When reclined to the supine position, the sewn arms merely flop to the sides of the torso in a reasonably lifelike manner.

Although described with respect to a doll having the shape of an infant or a small child, the various internal mechanisms can be implemented within any form of doll or robot to achieve the desired motions. Thus, for example, the mechanisms could be implemented within a toy doll having the shape of a teddy bear or other animal. Also, although the arms of toy doll 10 are not shown as being connected with the internal mechanism, an alternative configuration could be provided wherein the arms also move in coordination with the movement of the head or torso.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A toy doll comprising:

a torso with a pair of legs pivotally mounted to a bottom portion of said torso;

a head pivotally mounted to a top of said torso for pivoting between an extended position wherein said head extends upwardly from said torso, and a forward position wherein said head is tilted forward with respect to said torso, with a chin of said head proximate a chest of said torso; and automatic means for repositioning said doll from a sitting position wherein said doll sits upright with the legs of the doll extending forward from the torso for supporting the torso upright on a supporting surface to a reclined position wherein said torso and said legs lie supine on said supporting surface, including first triggering means, operable only while said torso is in said upright position and said head is in said extended position, for triggering said forward head pivot means to pivot said head to said forward position, and second triggering means, operable only while said torso is in said upright position and responding as said head reaches said forward position, triggering said torso pivot means to pivot said torso to said reclined position.

2. The toy doll of claim 1, wherein said head includes biasing means for biasing movement of said head from said extended position to said forward position while said torso is positioned upright, retaining means for holding said head in said extended position while said torso is positioned upright, and release means for releasing said retaining means to allow said biasing means to pivot said head to said forward position.

3. The toy doll of claim 2, wherein said head pivots about a pivot axis, and a center of gravity of said head is positioned forward from said axis while said head is in said extended position and said torso is in said upright position such that said head is biased by gravity to pivot to the forward position.

4. The toy doll of claim 1, wherein said doll further includes automatic rearward head pivot means for pivoting said head from said forward position to said extended position.

5. The toy doll of claim 4, wherein said head includes biasing means for biasing movement of said head from said forward position to said extended position while said torso is supine.

6. The toy doll of claim 4, wherein said head pivots about a pivot axis, and a center of gravity of said head is positioned rearward from said axis while said head is in said forward position and said torso is supine such that said head is biased by gravity to pivot to the extended position wherein said head lies parallel with said torso on said supporting surface.

7. The toy doll of claim 1, wherein said legs are pivotally attached to a bottom portion of said torso, and said means for repositioning said doll from the sitting position to the reclined position comprises torso pivot means for pivoting said torso rearwardly with respect to said legs.

8. The toy doll of claim 7, wherein torso pivot means comprises a spring having a first end affixed to a member connected to said legs and a second end affixed to an interior of said torso, said spring biasing said torso to pivot with respect to said legs to a position wherein said torso is parallel with said legs.

9. The toy doll of claim 8, wherein said torso pivot means includes means for slowing the pivoting of said torso.

10. The toy doll of claim 1, wherein said head includes means for slowing the pivoting of said head.

11. The toy doll of claim 1, wherein one of said triggering means is activated by squeezing a foot of one of said legs.

12. The toy doll of claim 1, further including sound generation means for generating sound.

13. The toy doll of claim 12, wherein said sound generating means is responsive to said means for repositioning said doll to produce sound at least while said doll is automatically repositioned.

* * * * *